United States Patent [19]

Johnson

[11] Patent Number: 4,510,763

[45] Date of Patent: Apr. 16, 1985

[54] AUTOMOTIVE TYPE AIR CONDITIONING SYSTEM AND METHOD OF OPERATING SUCH

[75] Inventor: Ronald L. Johnson, Prophetstown, Ill.

[73] Assignee: General Electric Company, Fort Wayne, Ind.

[21] Appl. No.: 566,846

[22] Filed: Dec. 29, 1983

Related U.S. Application Data

[62] Division of Ser. No. 411,296, Aug. 25, 1982, Pat. No. 4,458,117.

[51] Int. Cl.[3] ..... F25B 49/00

[52] U.S. Cl. ..... 62/115; 62/228.3; 200/83 P

[58] Field of Search ..... 62/228.3, 115; 200/83 R, 83 A, 83 B, 83 P, 83 W, 83 WM, 83 J, 83 Y

[56] References Cited

U.S. PATENT DOCUMENTS

| | | | |
|---|---|---|---|
| 2,057,101 | 10/1936 | Kagi | 62/228.3 X |
| 2,700,716 | 1/1955 | Grooms | 200/140 |
| 2,720,084 | 10/1955 | Hailey | 62/228.3 X |
| 3,110,160 | 11/1963 | Miner | 62/228.3 X |
| 3,498,075 | 3/1970 | Zumbiel | 200/83 R X |
| 4,121,074 | 10/1978 | Orcutt et al. | 200/83 P |
| 4,330,695 | 5/1982 | Poling | 200/83 |
| 4,339,740 | 7/1982 | Greenhalgh | 337/39 |
| 4,414,820 | 11/1983 | Morris | 62/228.3 |

*Primary Examiner*—William E. Tapolcai
*Attorney, Agent, or Firm*—Joseph E. Papin

[57] ABSTRACT

An automotive type air conditioning system has refrigerant compressor means with a discharge side and a suction side respectively connected in the system and operable generally for establishing refrigerant fluid pressure at the discharge side thereof and circulating the refrigerant through the system to the suction side of the compressor means. Means is selectively energized for coupling in driving relation with the compressor means to effect its operation in the system. A control device is operable generally in response to both a preselected high value and a preselected low value of the refrigerant fluid pressure established in the system at least generally adjacent the discharge side of the compressor means for selectively effecting the deenergization of the coupling means to interrupt the driving relation thereof with the compressor means.

A method of operating the system is also disclosed.

8 Claims, 19 Drawing Figures

AUTOMOTIVE TYPE AIR CONDITIONING SYSTEM AND METHOD OF OPERATING SUCH

CROSS-REFERENCE TO RELATED APPLICATION

This application is a division of parent application Ser. No. 411,296 filed Aug. 25, 1982, now U.S. Pat. No. 4,458,117, and is related to the commonly assigned and copending Ronald L. Johnson application Ser. No. 378,485 filed May 14, 1982 entitled "Electric Circuit Controlling Device And Method Of Operating Same" which along with the aforementioned parent application is incorporated herein by reference.

FIELD OF THE INVENTION

This invention relates in general to air conditioning systems and in particular to those utilized in automotive vehicles and a method of operating an automotive type air conditioning system.

BACKGROUND OF THE INVENTION

In the past air conditioning systems for automotive vehicles, temperature responsive means, such as a thermostatic switch or the like for instance, was associated with an evaporator coil of such systems to ascertain the temperature thereof, and the thermostatic switch was operable within a preselected temperature range to control the energization of a clutch mechanism operable generally for effecting the drive of a refrigerant compressor in such system. Thus, the thermostatic switch was connected in the electric circuit controlling the vehicle air conditioning system and operable in response to preselected high and low temperatures at the evaporator coil of such system to effect the deenergization and energization of the clutch mechanism which, in turn, effected the idling and driving of the compressor in such system, respectively. In this manner, the thermostatic switch cycled the vehicle air conditioning system in response to the temperature of the evaporator coil thereof which, of course, was correlative with the temperature of the refrigerant circulated through such evaporator coil by the compressor.

It was also desirable to utilize a high pressure cutout switch and a low pressure cutout switch in the past air conditioning systems along with the aforementioned cycling thermostatic switch. The past high pressure cutout switch was connected in the air conditioning system in pressure fluid communication with the discharge or high pressure side of the compressor. In the event that the fluid pressure at the high pressure side of the compressor rose to a preselected high value, the high pressure cutout switch was actuated in response thereto so as to interrupt the electrical circuit to the clutch mechanism deenergizing it thereby to turn off the compressor. Thus, the high pressure cutout switch was operable to insure that the fluid pressure developed in the vehicle air conditioning system did not exceed a preselected safe high value thereof. In addition to the high pressure cutout switch, it was also necessary to utilize a low pressure cutout switch in the past automotive air conditioning systems which was connected therein in pressure fluid communication with the suction or low pressure side of the compressor. In the event that the fluid pressure at the low pressure side of the compressor fell to a preselected low value, the low pressure cutout switch was actuated in response thereto so as to interrupt the electrical circuit to the clutch mechanism deenergizing it thereby to turn off the compressor. Thus, the low pressure cutout switch was operable to insure that the air conditioning system could not be operated when the fluid pressure therein at the low pressure side of the compressor fell to the preselected safe low value, i.e., for instance if the system should lose its refrigerant charge. At least one of the disadvantageous or undesirable features of the above discussed past automotive type air conditioning system is believed to be that two separate electric circuit control devices, i.e., the high pressure cutout switch and the low pressure cutout switch, were individually employed to provide the separate operating functions of each such switch in such system.

SUMMARY OF THE INVENTION

Among the several objects of the present invention may be noted the provision of an improved automotive type air conditioning system and an improved method of operating such system which overcome at east the above discussed disadvantageous or undesirable features, as well as others, of the prior art systems and; the provision of such improved, system and methods in which multiple circuit controlling functions are incorporated into a single control device; the provision of such improved, system and methods in which the multiple circuit controlling functions are effected by a pair of snap action members in response to a force applied thereon acting in only one direction; the provision of such improved system and methods in which the snap action members are arranged in engaging and opposite relation with each other so as to be capable of discrete snap action movements in response to different preselected levels of the force applied thereon in only the one direction for actuating at least one switch mechanism between a pair of switching modes thereof; and the provision of such improved, system and methods in which the component parts utilized therein are simple in design, economically manufactured and easily assembled. These as well as other objects and advantageous features of the present invention will in part be apparent and in part pointed out hereinafter.

An automotive type air conditioning system in one form of the invention has a refrigerant compressor means with a discharge side and a suction side respectively connected in the system and operable generally for establishing refrigerant fluid pressure at the discharge side thereof and circulating the refrigerant through the system to the suction side of the compressor means. Means is selectively energized for coupling in driving relation with the compressor means to effect its operation in the system. A control device is operable generally in response to both a preselected high value and a preselected low value of the refrigerant fluid pressure established in the system at least generally adjacent the discharge side of the compressor means for selectively effecting the deenergization of said coupling means to interrupt the driving relation thereof with said compressor means.

Still in general and in one form of the invention, a method is provided for operating an automotive type air conditioning system which has a refrigerant compressor with a discharge side and a suction side connected in the system. A clutch device is adapted for coupling in driving relation with the compressor, and a control device connected in the system in refrigerant pressure fluid communication with the discharge side of the compressor is adapted for operating a switch between a pair of switching modes thereof with the switch being connected in a circuit between a power source and a coil means for actuating the clutch device. In this method, the refrigerant fluid pressure in the system at least generally at the compressor discharge side is monitored. The control device is operated in response to the occurrence of either a preselected high value or a preselected low value of the monitored refrigerant fluid pressure to respectively effect the movement of the switch to one of the switching modes thereof, and the circuit is interrupted when the switch is in its one switching mode thereby to effect the deenergization of the coil means interrupting the driving relation of the clutch device with the compressor.

DETAILED DESCRIPTION OF THE PREFERRED EMBODIMENTS

Figure 1:
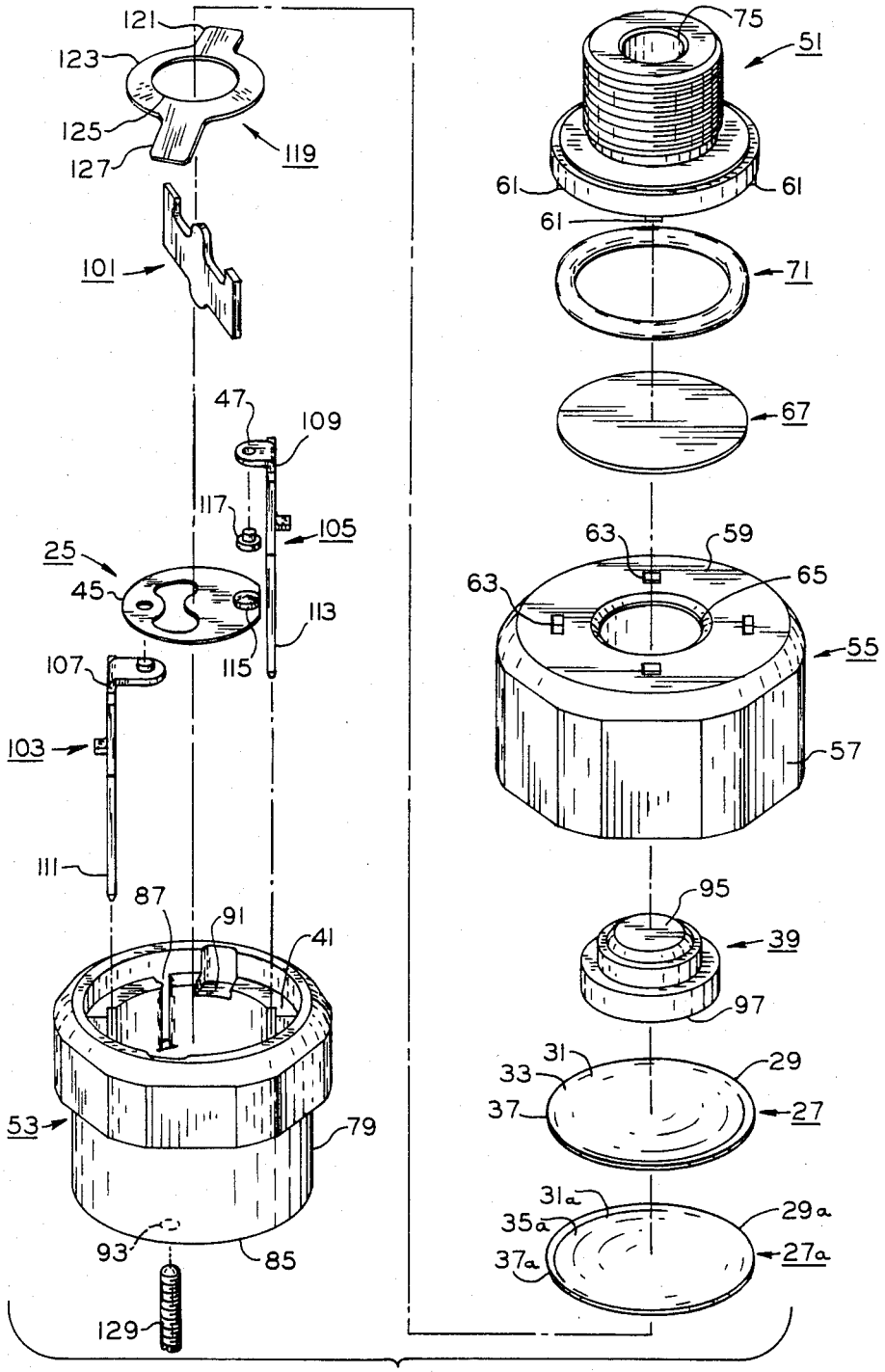
FIG. 1 is an exploded perspective view illustrating a control device and also teaching principles which may be practiced in a method of operating a control device.
Figure 4:
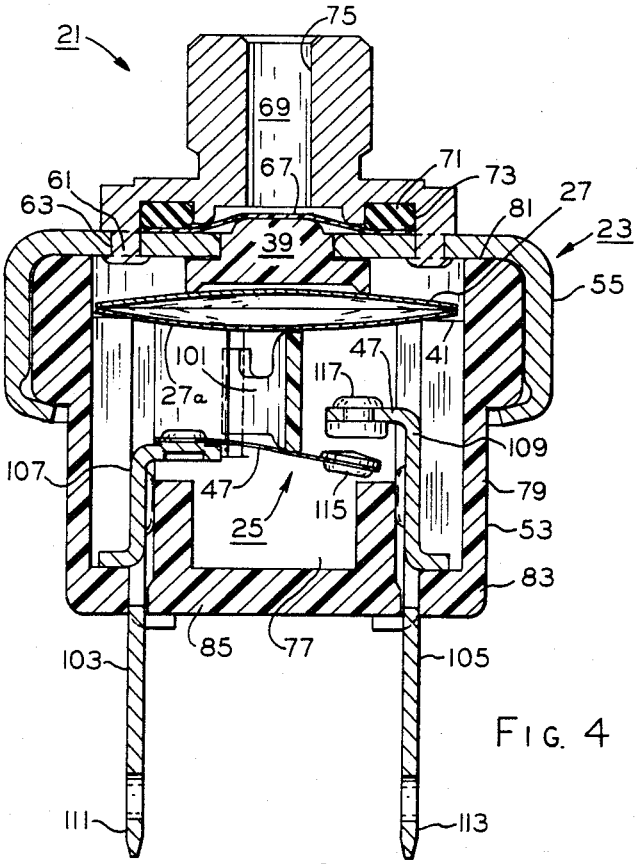
FIGS. 3 and 4 are sectional views taken along lines 3—3 and 4—4 in FIG. 2, respectively.
Figure 2:
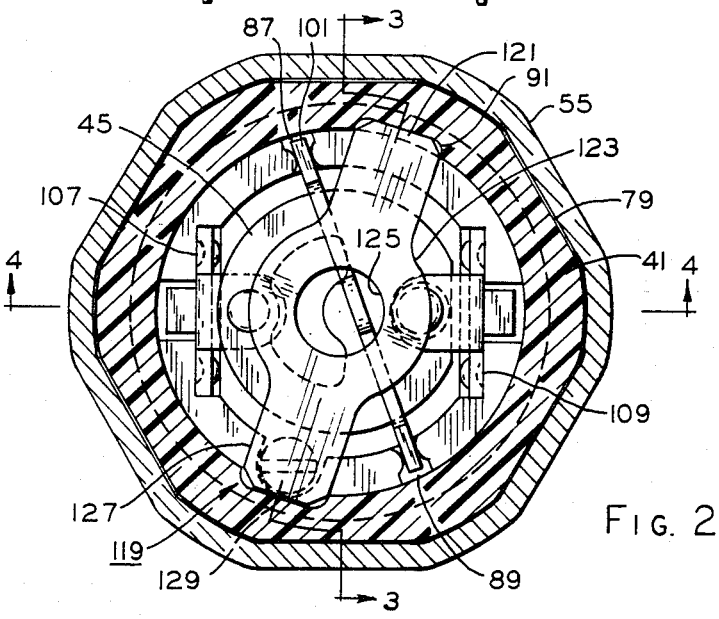
FIG. 2 is a sectional view illustrating the control device of FIG. 1 in cross section.
Figure 3:
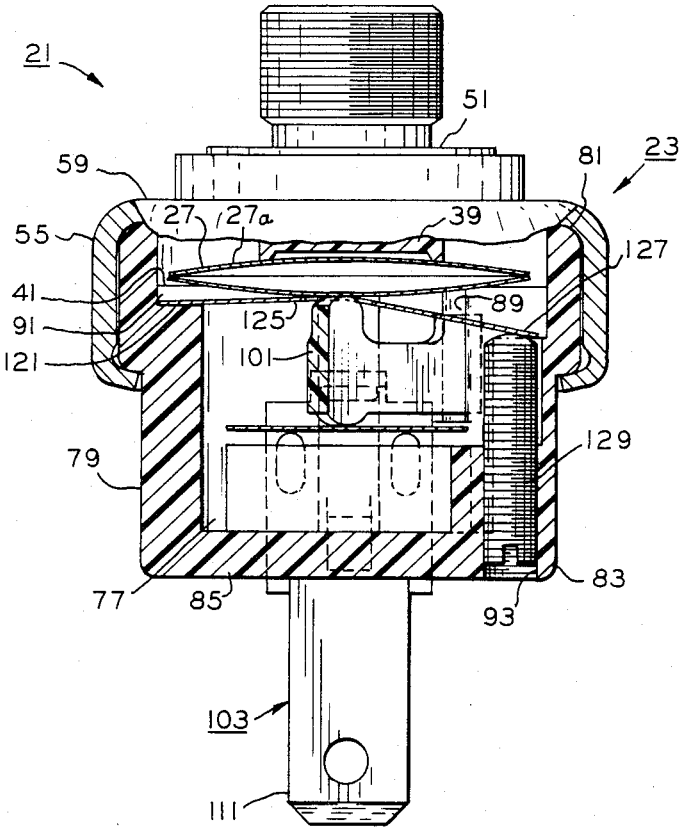
Figure 5:
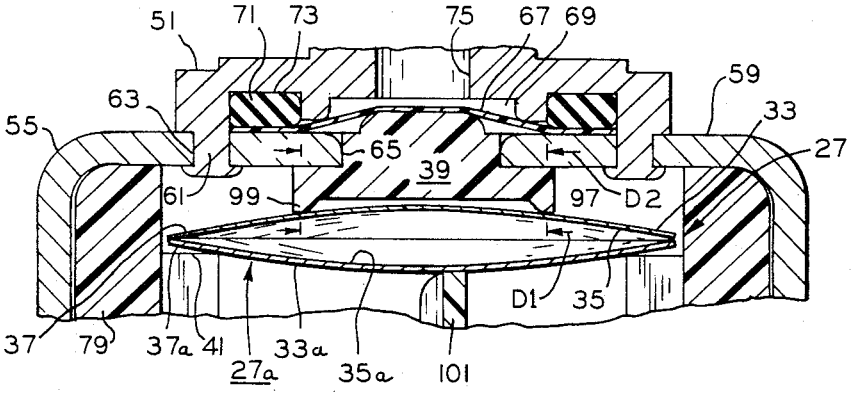
FIG. 5 is an enlarged partial view taken from FIG. 2.
Figure 6:
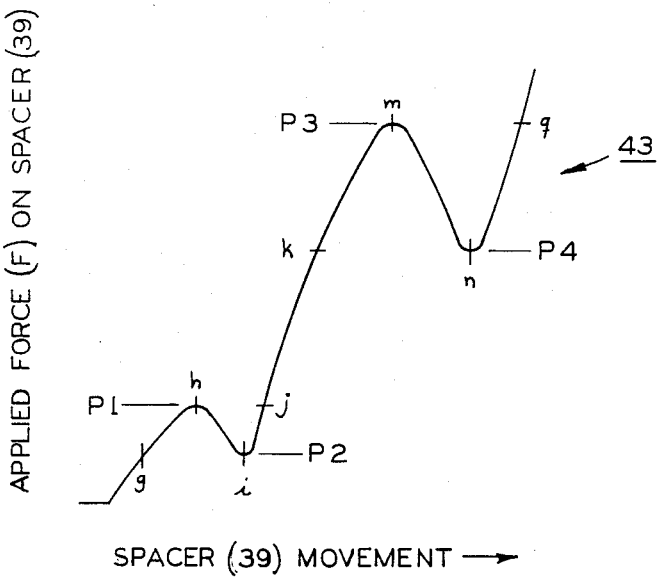
FIG. 6 is a graphical representation of a force-displacement curve revealing one type of interaction attainable by the force transmitting and snap action components of the control device illustrated in FIGS. 2–5, respectively.
Figure 7A:
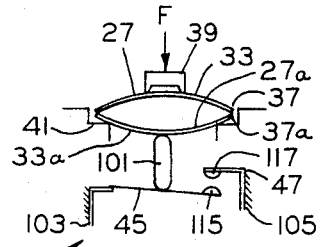
FIG. 7A is a schematic view of the force transmitting, snap action and switch components of the control device of FIGS. 1–5 illustrating the snap action components in their stable configuration with the switch component in an open circuit switching mode thereof, respectively.
Figure 7B:
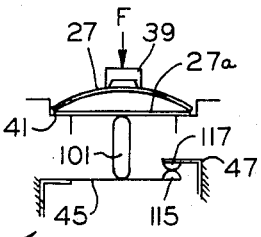
FIG. 7B is the same as FIG. 7A but with one of the snap action components in its unstable configuration with the switch component in a closed circuit switching mode thereof.
Figure 7C:
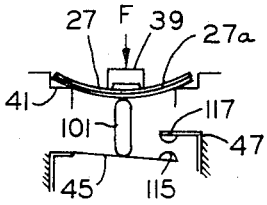
FIG. 7C is also the same as FIG. 7A but with the other of the snap action components illustrated in its unstable configuration drivingly engaged with the one snap action component returning it to its stable configuration and with the switch component returned to its open circuit switching mode.

With reference to the drawings in general, there is shown a method for operating a control device, such as a staging pressure switch device 21 or the like for instance (FIGS. 1–6 and 7A–7C). Device 21 has a housing 23, and means, such as a switch or switch mechanism 25 or the like for instance, disposed in the housing is operable generally for switching between a pair of switching modes thereof (FIGS. 1, 2 and 7A–7C). A pair of snap action means, such as for instance, mono-stable snap action members 27, 27*a* or the like, arranged in housing 23 are operable generally for discrete snap action movement in opposite directions between stable and unstable configurations thereof and with the snap action members being associated in engaging and oppositely extending or facing relation, respectively (FIGS. 1–3, 5 and 7A–7C). In this method, an increasing force F is applied or exerted in only one direction onto snap action members 27, 27*a* (FIGS. 7A–7C). Snap action member 27*a* is moved through its discrete snap action movement in one of the opposite directions to effect the operation of switching means or switch 25 from one of the switching modes to the other of the switching modes thereof, i.e., from the open circuit position or mode to the closed circuit position or mode for instance, when applied force F attains a preselected level or value P1 (FIGS. 6 and 7B). Snap action member 27 is also moved through its discrete snap action movement in the other of the opposite directions to engage and drive snap action member 27*a* conjointly therewith returning it through its discrete snap action movement in the other opposite direction to effect the return operation of switch 25 to its one switching mode, i.e., its open circuit position for instance, when applied force F attains or is increased to another preselected level or value P3 predeterminately greater than the preselected level or value P1 thereof (FIGS. 6 and 7C).

More particularly and with specific reference to FIGS. 1–3 and 5, snap action members 27, 27*a* may be formed from any suitable generally thin sheet material, such as for instance a stainless steel or the like, into the slightly bowed stable configurations thereon. In the stable configurations thereof, snap action members 27, 27*a* include a generally circular body 29, 29*a* having a generally arcuate, dome or dome-shaped section or portion 31, 31*a*, and a pair of generally arcuate or dome-shaped sides or surfaces 33, 35 and 33*a*, 35*a* are oppositely provided on the bodies defining the dome-shaped sections thereof, respectively. Opposite dome-shaped surfaces 33, 35 and 33*a*, 35*a* on snap action members 27, 27*a* interconnect with outer peripheral portions or marginal edge portions 37, 37*a* thereof which define a generally constant circumference of bodies 29, 29*a* about at least a major portion thereof, respectively. While snap action members 27, 27*a* and the above discussed shapes thereof are illustrated herein for purposes of disclosure, it is contemplated that various other snap action members having various other shapes may be utilized within the scope of the invention so as to meet at least some of the objects thereof. As disposed within housing 23 in their stable configurations, snap action members 27, 27*a* are arranged or otherwise positioned so that peripheral portions 37, 37*a* thereof are engaged at least in part and at least generally adjacent each other, respectively.

Generally concave or opposite surfaces 35, 35*a* of dome sections 31, 31*a* on snap action members 27, 27*a* are disposed so as to extend generally in opposite spaced apart and facing relation with each other respectively. Albeit not shown for purposes of brevity of disclosure, it is contemplated that peripheral portions 37, 37*a* of one of snap action members 27, 27*a* may be engaged with a dome-shaped surface 35, 35*a* of the other of snap action members 27, 27*a* within the scope of the invention so as to meet at least some of the objects thereof.

Applied force F is exerted in only the one direction, i.e., downwardly as best seen in FIGS. 2, 5 and 7A–7C, onto surface 33 on dome section 31 of snap action member 27 by a means, such as a spacer or piston 39 or the like for instance, for exerting or transferring the applied force, and surface 33*a* on dome section 31*a* of snap action member 27*a* is urged or otherwise biased into engagement with a generally circular seat 41 provided therefor in housing 23. Thus, it may be noted that transferring means or spacer 39 is subjected to applied force F transmitting or transferring it to snap action member 27, and since peripheral portions 37, 37*a* of snap action members 27, 27*a* are arranged in abutment with each other, as previously mentioned, applied force F is also thus transferred onto snap action member 27*a* in its seating engagement with housing seat 41. When applied force F attains its preselected level P1, as illustrated on curve 43 of the force-movement diagram of FIG. 6, snap action member 27*a* is moved through its discrete snap action movement from the stable configuration, as shown in FIG. 7A, to the unstable configuration thereof, as shown in FIG. 7B, and surface 33*a* on dome section 31*a* of snap action member 27*a* is maintained biased into the engagement thereof with housing seat 41 during the discrete snap action movement of snap action member 27*a*. Switch 25 comprises a pair of switch elements 45, 47 mounted in housing 23, and at least switch element 45 is resilient and movable in following relation with snap action means 27*a* so as to make with and break from switch element 47 thereby to define the switching modes of switch 25. Therefore, upon the movement of snap action member 27*a* to its unstable configuration, switch element 45 is movable in following relation therewith from its open circuit position disengaged from switch element 47, as best seen in FIG. 7A, to its closed circuit position into making engagement with switch element 47, as best seen in FIG. 7B.

When applied force F transmitted by spacer 39 in only the one direction onto snap action members 27, 27*a* is increased so as to attain its preselected level P3, as best seen on curve 43 in FIG. 6, snap action member 27 is moved through its discrete snap action movement from the stable configuration to the unstable configuration thereof, as best seen in FIG. 7C. During this discrete snap action movement to its unstable configuration, at least a part of surface 35 on dome section 31 of snap action member 27 drivingly engages or abuts with at least a part of surface 35*a* on dome section 31*a* of snap action member 27*a*. Thereafter, in response to the abutment of snap action members 27, 27*a*, the snap action members are conjointly movable, and snap action member 27 is returned through its discrete snap action movement from the unstable configuration to the stable configuration thereof. Since switch element 45 is associated in following relation with snap action member 27*a*, as previously mentioned, switch element 45 is selectively returned from the closed circuit position, as best seen in FIG. 7B, to the open circuit position thereof, as best seen in FIG. 7C, when snap action member 27*a* is driven from the unstable configuration to the stable configuration thereof by snap action member 27 during its movement from the stable configuration to the unstable configuration thereof. In view of the foregoing, it may be noted that the discrete snap action movements of snap action member 27, 27*a* in response to increasing applied force F exerted thereon through spacer 39 is effective to cause the selective operation of switch 25 from the open circuit position to the closed circuit position thereof and then its return back to it open circuit position.

Referring again to the drawings in general and recapitulating at least in part with respect to the foregoing, control device 21 includes housing 23, and means, such as switch 25 or the like for instance, in the housing is generally selectively operable for switching the switching mode pair thereof (FIGS. 1 and 7A–7C). Snap action members 27, 27*a* in housing 23 are arranged in opposite and engaging relation with each other and are selectively operable relatively and conjointly through discrete snap action movements to effect the selective operation of switch 25 between its switching mode, respectively (FIGS. 2 and 7A–7C). Means, such as at least spacer 39 or the like for instance, is operable generally for exerting or transferring increasing applied force F in only the one direction onto snap action members 27, 27*a* to effect the selective relative and conjoint operation of the snap action members through their discrete snap action movements thereby to selectively operate switch 25 from one of the switching modes to the other of the switching modes thereof and back to the one switching mode (FIGS. 7A–7C).

More particularly and with specific reference to FIGS. 1–5, housing 23 of device 21 includes a pair of housing members 51, 53 retained in assembly positions against displacement by suitable means, such as a generally cup-shaped retainer 55 or the like for instance. Retainer 55 includes a sleeve 57 which is deformed into gripping engagement about a confronting part of lower housing member 53 exteriorly thereof, and a generally radially extending wall 59 integral with the sleeve is disposed generally between housing members 51, 53. A plurality of integral projections 61 on upper housing member 51 detachably fit into a plurality of accommodating apertures 63 provided therefor through radial wall 59 of retainer 55 thereby to retain the upper housing member against displacement with respect to the retainer and lower housing member 53, and the apertures are spaced about a generally central circular opening 65 through the radial wall of the retainer. It is, of course, understood that housing members 51, 53 and retainer 55 may be formed of any suitable material, such as a resin, a metal or a metal alloy for instance; however, in the automotive vehicle application illustrated herein for device 21, housing member 53 is formed of thermoplastic material while housing member 51 and retainer 55 are formed of a rust resistant metal. Although housing members 51, 53 and retainer 55 are shown herein as having particular shapes and associated in a particular manner for purposes of disclosure, it is contemplated that other housing members and retainers having various other shapes and associated in different manners may be utilized within the scope of the invention so as to meet at least some of the objects thereof.

A generally resilient or flexible diaphragm or diaphragm means 67 of any suitable material is sealably interposed between upper housing member 51 and radial wall 59 of retainer 55 so as to define with the upper housing an expansible pressure fluid chamber 69 therein. A seal, such as an O-ring 71 or the like for instance, is disposed in sealing engagement between an annular seating groove 73 provided therefor in upper housing member 51 and diaphragm 67 to assist in sealing chamber 69 which is connected in pressure fluid communication with a control port 75 provided in the upper housing member. Diaphragm 67 is arranged generally in overlaying relation with radial wall 59 of retainer 55 about opening 65 therein, and an effective area of the diaphragm is generally defined by the diameter of the diaphragm about which it may flex as discussed hereafter. Thus, effective area A of diaphragm 67 is subjected to established fluid pressure in chamber 69 to create applied force F for effecting the operation of device 21, as previously discussed, and diaphragm 67 and spacer 39 may be combined to comprise a means for transmitting applied force F to snap action members 27, 27*a*.

Lower housing member 53 includes a plurality of walls or wall means which define with radial wall 59 of retainer 55 and diaphragm 67 a switch chamber 77 within the lower housing member, and the wall means plurality comprises a generally annular stepped sidewall 79 having a pair of opposite ends 81, 83 with a generally radially extending base wall 85 integrally formed with the sidewall adjacent opposite end 83 thereof. Upper opposite end 81 of sidewall 79 is abutted against radial wall 59 of retainer 55 so as to extend generally in radially spaced relation about opening 65 through the retainer radial wall, and sleeve 57 of the retainer is deformed into gripping engagement with the confronting part of the sidewall exteriorly of lower housing member 53, as previously mentioned. A generally annular shoulder defining housing seat 41 is provided on sidewall 79 of lower housing member 53 so as to extend generally circumferentially thereabout within switch chamber 77 between opposite ends 81, 83 of the sidewall, and a pair of opposite generally vertically extending guide means or grooves 87, 89 are provided in the sidewall between base wall 85 thereof and seat 41 with each guide groove intersecting the seat. Intermediate the intersections of guide grooves 87, 89 with housing seat 41, a recess 91 is also provided in the housing seat, and a threaded opening 93 is provided in lower housing member 53 through base wall 85 thereof with the threaded opening being generally diametrally opposite recess 91 in switch chamber 77, as discussed hereinafter.

Dome section 31*a* of snap action member 27*a* is seated or supported on housing seat 41 within switch chamber 77 with the snap action members 27, 27*a* being associated in the engaging and opposite facing relation thereof, as previously discussed and as best seen in FIGS. 4 and 5, within the switch chamber. Spacer 39 is reciprocally or slidably movable within opening 65 through radial wall 59 of retainer 55 and has one opposite or upper end 95 in abutting or driven engagement with diaphragm 67 so as to be responsive to movement thereof. The other opposite or lower end 97 of spacer 39 has a generally circular or annular abutment or force transmitting section, such as a ridge 99 or the like for instance, which is biased or urged into force transmitting engagement with surface 33 on dome section 31 of snap action member 27. Circular ridge 99 on spacer end 97 has a push diameter D1 which is predeterminately greater than and opposite to a flex diameter D2 of the effective area of diaphragm 67. Thus, applied force F is transmitted by ridge 99 of spacer 39 in a generally circular pattern farther away from or in predetermined spaced relation with the centerpoint of snap action member 27, and the resistance of such snap action member to its discrete snap action movement from the stable configuration to the unstable configuration thereof in response to such applied force F is increased. While spacer 39 and its force transferring section or ridge 99 are illustrated herein for purposes of disclosure, it is contemplated that other spacers having different shapes, formed of any suitable material, and having force transmitting sections of different shapes may be utilized within the scope of the invention so as to meet at least some of the objects thereof. Further, if a more detailed discussion of the construction and function of spacer 39 is desired, reference may be had to the Ronald W. Poling U. S. Pat. No. 4,330,695 issued May 18, 1982 which is incorporated herein by reference as well as the aforementioned application Ser. No. 378,485 filed May 14, 1982.

As previously mentioned, switch element 45 is associated in following relation with snap action member 27*a*, and this association is effected through an actuator or abutment means 101 disposed in abutting engagement between surface 33*a* on dome section 31*a* of the snap action member and the switch element thereby to accomplish the above discussed operation of switch 25 in response to the discrete snap action movements of snap action members 27, 27*a*. Actuator 101 extends generally across switch chamber 77 and is slidably or reciprocally received in opposite guide grooves 87, 89 provided therefor in sidewall 79 of lower housing member 53. If a more detailed discussion of the construction and function of actuator 101 is desired, reference may be had to the aforementioned application Ser. No. 378,485 filed May 14, 1982.

A pair of electrical terminals 103, 105 are mounted by suitable means to base wall 85 on lower housing member 53 against displacement therefrom. Terminals 103, 105 include a pair of switch supporting sections 107, 109 extending within switch chamber 77 and a pair of electrical connector sections 111, 113 which extend exteriorly of base wall 85 on lower housing member 53, respectively. An electrical contact 117 is carried on switch supporting section 109 of terminal 105 thereby to comprise switch element 47. Switch element 45, which may be formed of any suitable thin strip material having desired electrical conductive and resilient properties, such as beryllium copper or the like for instance, has one opposite end portion thereof pivotally secured by suitable means to switch supporting section 107 of terminal 103. Another electrical contact 115 is carried on the other opposite end portion of switch element 45 so as to be pivotally urged by the resiliency of the switch element toward making engagement with contact 117 carried on switch supporting section 109 of terminal 105.

For calibrating the discrete snap action movements of snap action members 27, 27*a*, adjustably movable means is provided in device 21 and associated with snap action members 27, 27*a* for adjusting at least two of the force levels of the discrete snap action movements thereof. As shown, the adjustably movable means includes a somewhat flexible relatively thin strap 119 having spring-like characteristics and disposed in switch chamber 77 beneath snap action member 27*a*, as viewed in FIG. 1. One end 121 of the strap is seated in recess 91 which extends through housing seat 41 so as to be disposed slightly beneath snap action member 27*a* in spaced relation with it. A generally or intermediate central section 123 of the strap is enlarged and has a central opening 125 which accommodates a part of actuator 101 which extends therethrough. At least an angular part of the circumferential edge around central section 123 makes pressure contact with surface 33*a* on dome section 31*a* of snap action member 27*a*. Another end 127 of strap 119 remote from end 121 thereof depends away from snap action member 27*a* and is engaged by the end of an adjusting or turnable means, such as a screw 129 or the like for instance, threadably received in threaded opening 93 provided therefor through base wall 85 of lower housing member 53. Adjusting screw 129 through its contact with depending end 127 of strap 119 maintains central section 123 of the strap in pressure engagement with surface 33*a* on dome section 31*a* of snap action member 27*a*, and controls the degree of force applied at that generally central location to the snap acting member. With this arrangement, it will be observed that the adjusting screw 129 is also located outwardly from switch elements 45, 47 in switch chamber 77, and calibration may be achieved readily by turning the screw with a tool, such as a screwdriver or the like for instance, in the desired direction to reduce or increase the adjusting force exerted on snap action member 27*a*, which adjusting force is also effective on snap action member 27 due to the aforementioned engagement of peripheral portions 37, 37*a* of the snap action members. Strap 119 may be built of any suitable material, for example, stainless steel having a thickness of generally about 10 mils. To complete the description of device 21, adjustment of screw 129 provides an adjustment of force levels P1, P2 as shown on curve 43 in FIG. 6, at which snap acting member 27, 27*a* operate wherein the calibration force will have a lesser effect during the discrete snap action movement of snap action members 27, 27*a* from the stable configuration to the unstable configurations thereof in response to force P1, P2 than during the return discrete snap action movements of the snap action members from the unstable configurations to the stable configuration thereof. Conversely, the aforementioned adjustment of screw 129 will have a greater effect on force level P4 on curve 43 in FIG. 6 during the discrete snap action movement of snap action member 27 from the unstable configuration to the stable configuration thereof.

In the operation of device 21, assume that the component parts thereof are in their respective at-rest positions, as shown in FIGS. 2–5, and that the adjusting means has been adjusted to properly calibrate the device, as discussed hereinabove. As a control fluid pressure is established in chamber 69 of device 21, the control fluid pressure acts on the effective area of diaphragm 67 to create applied force F. Since upper end 95 of spacer 39 is abutted with diaphragm 67 and circular ridge 99 on lower end 97 of the spacer is abutted with dome section 31 of snap action member 27, the applied force F is transmitted from the diaphragm through the spacer onto the dome section of the snap action member. Due to the abutting engagement between peripheral portions 37, 37*a* of snap action members 27, 27*a*, the applied force F is transferred from snap action member 27 to snap action member 27*a* urging dome section 31*a* thereof toward its seating engagement with housing seat 41.

As applied force F is increased from zero to P1, say 1.2 pounds for example, as shown on force-deflection curve 43 of FIG. 6, spacer 39 is moved in a creeping manner from zero displacement through position or point g to h where snap action member 27*a* is caused to snap from its stable configuration, as seen in FIG. 7A, to its unstable configuration, as seen in FIG. 7B, in response to increasing applied force F exerted on snap action member 27 in only one direction. Of course, upon this discrete snap action movement of snap action member 27*a* from the stable configuration to the unstable configuration thereof, spacer 39 is displaced from position or point h to j, and the resiliency of switch element 45 causes it to follow snap action member 27*a* from the open circuit position, as seen in FIG. 7A, to the closed circuit position, as seen in FIG. 7B, making contacts 115, 117 carried on switch elements 45, 47 thereby to complete the electrical circuit through device 21 between terminals 103, 105 thereof. When switch 25 is in the closed circuit position thereof, the preselected low value or level P2 of applied force F1 required to maintain the closed circuit position may be about 1.0 pounds for example.

When applied force F1 is increased to its preselected high value or level P3, say approximately 16 pounds for instance, spacer 39 is further moved in a creeping manner from position or point j to m on curve 43 where snap action member 27 is caused to snap from its stable configuration, as seen in FIG. 7B, to its unstable configuration, as seen in FIG. 7C. Of course, upon this discrete snap action movement of snap action member 27 from the stable configuration to the unstable configuration thereof, spacer 39 snaps from position or point m to q on curve 43 of FIG. 6. It may be noted that during the aforementioned discrete snap action movement of snap action member 27 from the stable configuration to the unstable configuration thereof, snap action member 27 drivingly engages snap action 27*a* effecting conjoint movement thereof so as to return snap action member 27*a* from the unstable configuration, as seen in FIG. 7B, to the stable configuration thereof, as seen in FIG. 7C. When snap action member 27*a* is so returned to its stable configuration, the snap action member conjointly drives abutment 101 downwardly therewith to return switch element 45 to the open circuit position breaking its contact 115 from contact 117 on switch element 47 thereby to interrupt the circuit through device 21 between terminals 103, 105 thereof. In view of the foregoing, it may be noted that snap action members 27, 27*a* are operable through their discrete snap action movements in response to increasing applied force F exerted thereon in only one direction to cause the successive or sequential operation of switch 25 from its open circuit position to its closed circuit position and then back to its open circuit position, as discussed above and as illustrated in FIGS. 7A–7C.

When the control fluid pressure in chamber 69 acting on diaphragm 67 is decreased, applied force F is correspondingly decreased. Therefore, upon the decrease of applied force F to a value P4, say for instance 12 pounds as illustrated on curve 43 in FIG. 6, spacer 39 creeps from positon q to n and then snaps to position k as snap action member 27 reverts from its unstable configuration, as seen in FIG. 7C, to its stable configuration, as seen in FIG. 7B. Upon this reversion of snap action member 27 to its stable configuration, snap action member 27*a* follows moving with discrete snap action from its stable configuration, as seen in FIG. 7C, to its unstable configuration, as seen in FIG. 7B, since applied force F has been reduced below the preselected high value P4 thereof, as mentioned above. Of course, when snap action member 27*a* moves to its unstable configuration, the resiliency of switch element 45 causes it to follow to the closed circuit position thereof remaking contact 115 with contact 117 on switch element 47 thereby to complete the circuit through device 21 between terminals 103, 105 thereof. As applied force F is further decreased to preselected low value P2 thereof, spacer creeps from position k to i on curve 43 and then snaps to position g as snap action member 27*a* reverts from its unstable configuration, as seen in FIG. 7B, to its stable configuration, as seen in FIG. 7A. As snap action member 27*a* reverts to its stable configuration, it drives abutment 101 downwardly against switch element 45 moving it to the open circuit position breaking contact 115 from contact 117 on switch element 47 thereby to again interrupt the circuit through device 21 between terminals 103, 105 thereof.

Figure 8A:
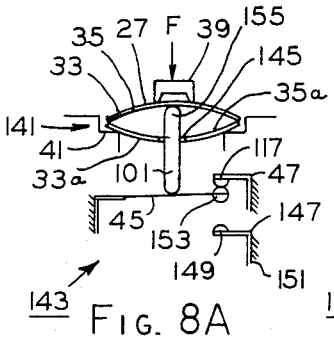
FIGS. 8A, 8B and 8C are schematic views of alternative snap action and switch components which may be utilized in the control device of FIGS. 1–5 with the positions of such components being related to those illustrated in FIGS. 7A, 7B and 7C, respectively.
Figure 8B:
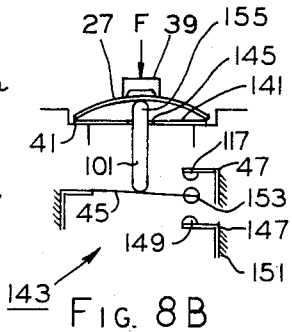
Figure 8C:
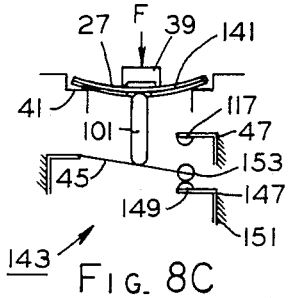

Turning now to FIGS. 8A, 8B and 8C, an alternative snap action member 141 and switch 143 which may be utilized in device 21 are shown having generally the same component parts and functioning generally in the same manner as the previously discussed snap action member 27*a* and switch 25 with the exceptions discussed hereinafter.

Snap action member 141 is provided with a generally central opening 145 through dome section 31*a* intersecting with surfaces 33*a*, 35*a* thereof, respectively, and switch 143 is of the single pole, double throw type, i.e., an on-off-on type. Switch 143 includes an additional switch element 147 having an electrical contact 149 thereon arranged in spaced relation with contact 117 of switch element 47, and switch element 147 is associated with an additional terminal 151 supported in device 21. Switch element 45 has a double contact 153 for making and breaking with contacts 117, 149 of switch elements 47, 147, respectively. Abutment 101 is provided with an extension 155 thereon which extends through opening 145 in snap action member 141 into engagement with surface 35 of snap action member 27. By sequencing the snap action movements of snap action members 27, 141 in accordance with the displacement of spacer 39, as discussed hereinabove with respect to curve 43 of FIG. 6, snap action member 27 will move switch element 45 from the closed circuit position, as seen in FIG. 8A, to the open circuit position, as seen in FIG. 8B; and back to the open circuit position, as seen in FIG. 8C.

Figure 9A:
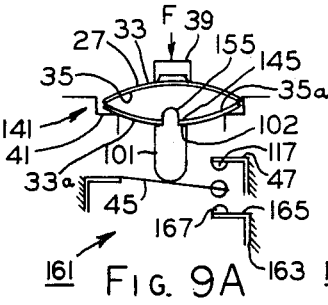
FIGS. 9A, 9B and 9C are schematic views of other alternative snap action and switch components which may be utilized in the control device of FIGS. 1–5 with the positions of such components being related to those illustrated in FIGS. 7A, 7B and 7C, respectively.
Figure 9B:
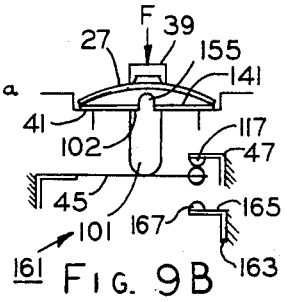
Figure 9C:
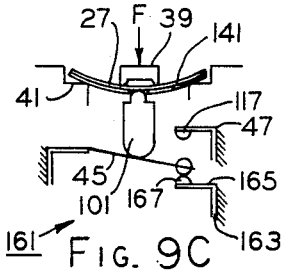

In FIGS. 9A, 9B and 9C, an alternative switch 161 which may be utilized in device 21 is shown having generally the same component parts and functioning generally in the same manner as the previously discussed switches 25, 143 with the exceptions discussed hereinafter.

Switch 161 is also of the single pole, double throw type having an off-on-on operational sequence and includes an additional terminal 163 having a switch element 165 carrying a contact 167 arranged in spaced apart relation with contact 117 of switch element 47. Switch element 45 has a double contact 169 for making and breaking with contacts 117, 167, respectively. Abutment 101 is provided with a shoulder or abutment 102 engaged with snap action member 141 so as to bias switch element 45 toward an open circuit position breaking its double contact 169 from contacts 117, 167 on switch elements 47, 165. By sequencing the snap action movements of snap action members 27, 141 in accordance with the displacement of spacer 39, as discussed hereinbefore with respect to curve 43 of FIG. 6, the snap action members will move switch element 45 from the open circuit position, as seen in FIG. 9A, to the closed circuit position, as seen in FIG. 9B, and then to another closed circuit position thereof, as seen in FIG. 9C.

Figure 10A:
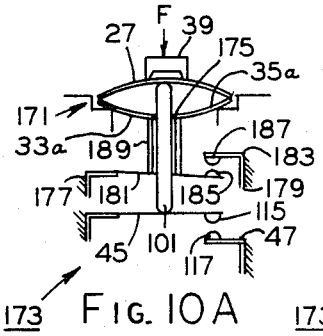
FIGS. 10A, 10B and 10C are schematic views of still other alternative snap action and switch components which may be utilized in the control device of FIGS. 1–5 with the positions of such components being related to those illustrated in FIGS. 7A, 7B and 7C, respectively.
Figure 10B:
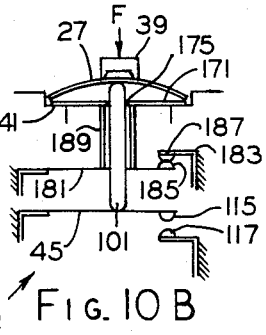
Figure 10C:
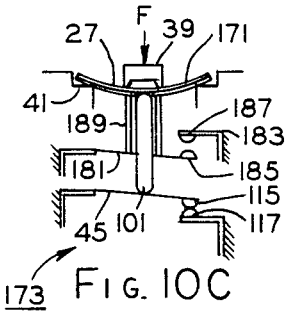

Referring now to FIGS. 10A, 10B and 10C, another alternative snap action member 171 and switch 173 which may be utilized in device 21 are shown having generally the same component parts and functioning generally in the same manner as the previously discussed snap action member 27 and switch 25 with the exceptions discussed hereinafter.

Snap action member 171 has a generally central opening 175 through dome section 31*a* intersecting with surfaces 33*a*, 35*a* thereof, respectively, and switch 173 is of the double pole, single throw type. Switch 173 includes another pair of terminals 177, 179 which may be mounted to device 21. Another pair of switch elements 181, 183 having a pair of contacts 185, 187 thereon are mounted to terminals 177, 179, respectively, with at least switch element 181 being movable. Actuator 101, in the at-rest position thereof, urges switch element 45 to an open circuit position, as seen in FIG. 10A, and another actuator 189 extends about actuator 101. Actuator 189 also extends about opening 175 in snap action member 171 so as to abut between switch element 181 and surface 33*a* of dome section 31*a* on snap action member 171 with switch element 181 also being in an open circuit position, as seen in FIG. 10A. By sequencing snap action members 27, 171 in accordance with the displacement of spacer 39, as discussed hereinabove with respect to curve 43 of FIG. 6, snap action member 171 will effect the movement of switch element 181 from its open circuit position, as seen in FIG. 10A, to the closed circuit position, as seen in FIG. 10B, while switch element 45 remains in the open circuit position thereof. Thereafter, snap action member 27 moves switch element 45 from its open circuit position, as seen in FIG. 10B, to the closed circuit position thereof, as seen in 10C, and snap action member 27 also conjointly drives snap action member 171 to move switch element 181 from its closed circuit position, as seen in FIG. 10B, to the open circuit position thereof, as seen in FIG. 10C.

Figure 11:
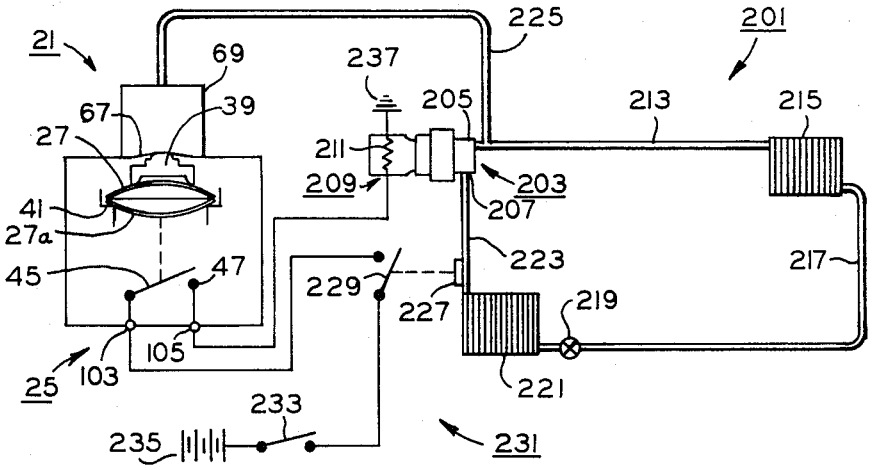
FIG. 11 is a schematic view illustrating an automotive type air conditioning system in one form of the invention utilizing the control device of FIGS. 1–5 which is also schematically illustrated in the system and also teaching principles which may be practiced in a method of operating such system also in one form of the invention.

With reference again to the drawings in general and recapitulating at least in part with respect to the foregoing, there is shown in one form of the invention an automotive type air conditioning system 201 having a refrigerant compressor or compressor means 203 with a discharge side 205 and a suction side 207 respectively connected in the system, and the compressor is operable for establishing refrigerant fluid pressure at the discharge side thereof and circulating the refrigerant through the system to the suction side of the compressor (FIG. 11). Means, such as a clutch device 209 having an energizing coil or coil means 211 for instance, is selectively energized for coupling in driving relation with compressor 203 to effect its operation in system 201 (FIG. 11). Control device 21 is operable generally in response to both a preselected high value P4 and a preselected low value P2 of the refrigerant fluid pressure established in system 201 at least generally adjacent discharge side 205 of compressor 203 for selectively effecting the deenergization of coil means 211 to interrupt the driving relation of clutch device 209 with the compressor (FIGS. 1–6 and 11).

More particularly and with specific reference to FIG. 11, when compressor 203 is so operated or driven in system 201, refrigerant in the vapor stage thereof is drawn from suction side 207 of the compressor, compressed by the compressor, and discharged from discharge side 205 thereof as a hot high pressure vapor through a conduit 213 to a condenser 215. Upon passage through condenser 215, the hot high pressure vaporized refrigerant is cooled and condensed thereby to effect a change of state in the refrigerant which is discharged from the condenser as a cold high pressure liquid through a conduit 217. An expansion or orifice tube or valve 219 is disposed in conduit 217 between condenser 215 and an evaporator 221, and as the cold high pressure liquid refrigerant is passed or orificed through the expansion valve, a pressure drop occurs which again effects a change in state of the refrigerant so that the refrigerant enters the evaporator as a cold low pressure vapor. Of course, from evaporator 221, the cold low pressure vaporized refrigerant is delivered through a conduit 223 back to suction side 207 of compressor 203 for recirculation through system 201. Conduit 213 intersects in pressure fluid communication with another conduit 225 leading to chamber 69 of control device 21 so as to effect the monitoring of the refrigerant fluid pressure at discharge side 205 of compressor 203.

Means, such as a thermostat 227 or the like for instance, is associated in thermal transfer relation with conduit 223 for ascertaining the temperature of the low pressure vaporized refrigerant flowing therethrough from evaporator 221 to suction side 207 of compressor 203, and in response to preselected low and high values of the refrigerant temperature in conduit 223, the thermostat operates a switch 229 between a pair of switching modes in an electrical control circuit 231 for system 201. Switch 229 has one side thereof serially connected in circuit relation with a means, such as an operator actuated or enabling switch 233 or the like for instance of the automotive vehicle, for enabling circuit 231, and the enabling means or switch 233 is serially connected in circuit relation with a D.C. power source, such as a battery 235 or the like for instance of the automotive vehicle. Thus, when enabling switch 233 is actuated by an operator to its closed circuit or circuit completing position, thermostat 227 functions to operate its switch 229 so as to cycle system 201 thereby to maintain a desired temperature level in the automotive vehicle compartment conditioned by the system. To complete the description of system 201, control device 21 has its switch 25 serially connected in circuit relation between the other side of thermostatic switch 229 and coil means 211 of clutch device 209, and the coil means is connected to ground at 237. While system 201 is illustrated herein for purposes of disclosure, it is contemplated that other automotive type air conditioning systems having various other or additional components may be utilized within the scope of the invention so as to meet at least some of the objects thereof.

In the operation of system 201, assume that switches 233, 229 and 25 are in the closed circuit positions thereof so that coil means 211 is energized from battery 235 through the closed switches to ground 237. With coil means 211 so energized, clutch 209 is actuated into the driving or coupling relation thereof with compressor 203 to effect its operation circulating refrigerant from discharge side 205 to suction side 207 thereof through system 201, as previously discussed. Of course, thermostat 227 is responsive to the occurrence of the preselected high and low temperatures of the refrigerant in conduit 223 of system 201 to cycle thermostatic switch 229 between its closed and open circuit position in order to maintain the vehicle compartment conditioned by the system at a desired or selected temperature therefor. Thus, when thermostatic switch 229 is so cycled, circuit 231 to coil means 211 is cyclically completed and interrupted thereby to cyclically energize and deenergize the coil means which, of course, cyclically effects and interrupts the driving relation between clutch 209 and compressor 203. Of course, when enabling switch 233 is moved to its open position by the vehicle operator, circuit 231 is disabled so as to obviate the energization of clutch coil 211 as well as the driving relation between clutch 209 and compressor 203 thereby to also disable or turn off system 201.

Control device 21 functions to monitor the refrigerant fluid pressure in system 201 at discharge side 205 of compressor 203, and to accomplish this function, chamber 69 of the control device is connected through conduits 205, 225 with the compressor discharge side, as previously mentioned. When the refrigerant fluid pressure in system 201 at compressor discharge side 205 is within the operating range defined by the preselected high value P3 and the preselected low value P2 of control device 21, the control device is operative to maintain its switch 25 in the closed circuit position thereof, as previously discussed hereinabove with respect to FIGS. 6 and 7A–7C for instance. However, in the event the refrigerant fluid pressure system 201 at compressor discharge side 205 therein attains the preselected high value P3 or falls to the preselected low value P2, such as by the loss of refrigerant from the system for instance, control device 21 is operable in response to the occurrence of both the preselected high and low values P3, P2 to effect the movement of switch 25 thereof to its open circuit position, which operation of the control device is also discussed in detail hereinabove. When control device 21 is so operated in response to either the preselected high and low values P3, P2 of the refrigerant in system 201 at compressor discharge side 205, circuit 231 to clutch coil 211 is, of course, opened or interrupted irrespective of the switching modes of thermostatic switch 229 or enabling switch 233 in the circuit. Therefore, upon the operation of control device 21 in system 201 to open switch 25 in cirucit 231, energization of clutch coil 211 in the circuit is, of course, obviated as well as the driving relation of clutch 209 with compressor 203. Thus, control device 21 acts to insure safe operation of system 201 between preselected high and low values P3, P2 of refrigerant fluid pressure monitored generally at discharge or high pressure side 205 of compressor 203 in the system. Furthermore, it may be noted that control device 21 is operable in response to both the high and low values P3, P2 of the refrigerant monitored at compressor discharge side 205 in system 201 to insure the safe operation of the system only within the preselected or safe operating range thereof defined by the preselected high and low values P3, P2 of the monitored refrigerant pressure.

With reference again in general to the drawings and again recapitulating at least in part with respect to the foregoing, there is illustrated in one form of the invention a method of operating system 201 having compressor 203 with discharge and suction sides 205, 207 thereof connected in the system, and clutch device 209 is adapted for coupling in driving relation with the compressor (FIG. 11). Control device 21 connected in system 201 in refrigerant pressure fluid communication with compressor discharge side 205 is adapted for operating switch 25 between a pair of switching modes thereof, and the switch is connected in circuit 231 between power source 235 and coil means 211 for actuating clutch device 209 (FIGS. 2–6 and 11). In practicing this method, refrigerant fluid pressure is monitored or otherwise sensed in system 201 at least generally at compressor discharge side 205 (FIG. 11). In response to the occurrence of either the preselected high value P3 or the preselected low value P2 of the monitored refrigerant fluid pressure, control device 21 respectively operates to effect the movement of switch 25 to one of the switching modes thereof, and circuit 231 is interrupted when the switch is moved to its one switching mode thereby to effect deenergization of coil means 211 terminating the driving relation of clutch device 209 with compressor 203 (FIGS. 2–6, 7A–7C and 11).

From the foregoing, it is now apparent that a novel system 201 and a novel method of operating such have been presented meeting at least the objects and advantageous features set out herein, and it is contemplated that changes as to the precise arrangements, shapes, connections and other details of the constructions illustrated herein for purposes of disclosure, as well as the precise steps and orders thereof of such method, may be made by those having ordinary skill in the art without departing from the scope of such disclosure or the spirit of the invention as defined by the claims which follow.

I claim:

1. An automotive type air conditioning system comprising:

a battery;

refrigerant compressor means having a discharge side and a suction side respectively connected in the system and operable generally for establishing refrigerant fluid pressure at said discharge side and circulating the refrigerant through the system to said suction side of said compressor means;

a clutch device for coupling in driving relation with said compressor means to effect the operation thereof in the system and including coil means connected in circuit relation with said battery and adapted for energization in the circuit relation with said battery to effect the coupling of said clutch device in the driving relation thereof with said compressor means; and a pressure switch device including switch means connected in circuit relation between said coil means and said battery and operable generally between a closed circuit position for effecting the energization of said coil means from said battery and an open circuit position for effecting the deenergization of said coil means, a pair of snap action means movable through discrete snap action movements between stable and unstable configurations for causing the operation of said switch means, respectively, a pair of peripheral portions on said snap action means engaged at least generally adjacent each other, respectively, a pair of dome-shaped sections on said snap action means integral with said peripheral portions and disposed in opposite facing relation with each other, respectively, means for seating about one of said dome-shaped sections of one of said snap action means, means connected in pressure fluid communication with the system at least generally adjacent said discharge side of said compressor means and movable for exerting in only one direction the force of the refrigerant fluid pressure acting thereon onto the other of said dome-shaped sections of the other of said snap action means so as to urge said one dome-shaped section of said one snap action means toward said seating means therefor, said transmitting means being movable in response to a preselected high value of the refrigerant fluid pressure acting thereon to effect the discrete snap action movement of said other snap action means from the stable configuration to the unstable configuration thereof so as to engage and drive said one snap action means from the unstable configuration to the stable configuration thereof causing the operation of said switch means from its closed circuit position to its open circuit position thereby to effect the deenergization of said coil means and the interruption of the driving relation of said clutch device with said compressor means, and said transmitting means also being movable in response to a preselected low value of the refrigerant fluid pressure to effect the discrete snap action movement of said one snap action means from the unstable configuration to the stable configuration thereof when said other snap action means is in the stable configuration thereof also causing the operation of said switch means from its closed circuit position to its open circuit position thereby to also effect the deenergization of said coil means and the interruption of the driving relation of said clutch device with said compressor means.

2. A method of operating an automotive type air conditioning system having a refrigerant compressor with a discharge side and a suction side connected in the system and operable generally for circulating refrigerant through the system, a clutch device adapted for actuation in driving relation with the compressor, coil means associated with the clutch device and adapted for energization to actuate the clutch device, an electrical circuit device, an electrical circuit having a DC power source arranged in circuit relation with the coil means, and a control device including an expansible chamber connected in refrigerant pressure fluid communication in the system at least generally at the discharge side of the compressor, a pair of snap action members adapted for operation with discrete snap action movement between a stable configuration and an unstable configuration, the snap action members having a pair of peripheral portions engaged at least in part with each other and a pair of generally dome-shaped sections integral with the peripheral portions arranged in opposite facing relation with each other, respectively, means for seating at least in part generally about one of the dome-shaped sections of one of the snap action members, diaphragm means defining a part of the chamber, a spacer arranged in force transmitting engagement between the diaphragm means and the other of the dome-shaped sections of the other of the snap action members, at least one switch element movable between a closed circuit position and an open circuit position, and abutment means associated in following engagement between the one dome-shaped section of the one snap action member and the one switch element and with the one switch element being connected in the electrical circuit in circuit relation between the DC power source and the coil means, the method comprising the steps of:

subjecting the diaphragm means to the refrigerant fluid pressure in the chamber with the refrigerant fluid pressure acting on the effective area of the diaphragm to establish an applied force;

biasing conjointly the spacer and the diaphragm means in response to the applied force acting thereon and transmitting the applied force onto the other dome-shaped section of the other snap action member with the one dome-shaped section of the one snap action member being seated by the seating means therefor;

operating the one snap action member through its discrete snap action movement from the stable configuration to the unstable configuration thereof when the applied force transmitted onto the other snap action member attains at least a preselected low value therefor and is less than a preselected high value therefor and effecting the movement of the switch element from the open circuit position to the closed circuit position thereof upon the operation of the one snap action member to its unstable configuration;

completing the circuit from the DC power source to the coil means when the switch element is in its closed circuit position and energizing the coil means in the circuit;

actuating the clutch device into the driving relation thereof with the compressor in response to the energization of the coil means in the circuit and effecting thereby the operation of the compressor in the system to circulate refrigerant therethrough from the discharge side to the suction side of the compressor;

operating the other snap action member through its discrete snap action movement from the stable configuration to the unstable configuration thereof so as to drivingly engage and return the one snap action member to its stable configuration in the event the applied force transmitted onto the other snap action member is increased to the preselected high value thereof and alternatively effecting the return of the one snap action member to its stable configuration in the event the applied force transmitted onto the other snap action member is decreased to the preselected low value thereof without operating the other snap action member;

effecting the return of the switch element from the closed circuit position to the open circuit position thereof in response to the return of the one snap action member to its stable configuration;

interrupting the circuit from the DC power source to the coil means when the switch element is in its open circuit position and deenergizing the coil means; and deactuating the clutch device so as to effect its uncoupling from the compressor in response to the deenergization of the coil means in the circuit and terminating thereby the operation of the compressor in the system.

3. An automotive type air conditioning system comprising:

refrigerant compressor means operable generally for establishing refrigerant fluid pressure in the system;

a clutch device selectively energized and deenergized for coupling in driving relation with said refrigerant compression means to effect its operation in the system and for uncoupling from the driving relation with said refrigerant compressor means, respectively;

a control device including switching means operable generally between a pair of switching modes for controlling the energization and deenergization of said clutch device and thereby its driving relation with said refrigerant compressor means, at least a pair of snap action means associated in generally opposite and engaging relation with each other and operable generally relatively and conjointly through discrete snap action movements to effect the operation of said switching means between the switching modes thereof, and means subjected to the established refrigerant fluid pressure in a preselected part of the system and operable generally in response thereto for transmitting a force to said snap action means to effect the discrete snap action movements thereof, said force transmitting means being operable in response to a preselected high value and a preselected low value of the established refrigerant fluid pressure to effect the discrete snap action movement of one of the snap action members thereby to operate the switching means between its switching modes effecting the energization of said clutch device and the coupling thereof in the driving relation with the refrigerant compressor means when the switching means is in one of its switching modes and effecting the deenergization of said clutch device and the uncoupling thereof from the driving relation with said refrigerant compressor means when the switching means is in the other of the switching modes thereof, said force transmitting means also being responsive to a preselected range of the established refrigerant fluid pressure defined between the preselected low value and another preselected high value of the established refrigerant fluid pressure predeterminately in excess of the first named preselected high value thereof to effect the discrete snap action movement of the one snap action means to operate said switching means from the other switching mode to the one switching mode effecting the reenergization of said clutch device and the recoupling in the driving relation thereof with the refrigerant compressor means, and said force transmitting means being thereafter further responsive to the another preselected high value of the established refrigerant fluid pressure to effect the discrete snap action movements of each of said snap action means to further operate said switching means from the one switching mode to the other switching mode thereof thereby to again effect the deenergization of said clutch device and the uncoupling thereof from the driving relation with said refrigerant compressor means.

4. An automotive type air conditioning system comprising:

refrigerant compressor means operable generally for establishing refrigerant fluid pressure in the system;

a clutch device selectively energized and deenergized for coupling in driving relation with said refrigerant compressor means to effect its operation in the system and for uncoupling from the driving relation with said refrigerant compressor means, respectively;

a control device including switching means operable generally between a pair of switching modes for controlling the energization and deenergization of said clutch device and thereby its driving relation with said refrigerant compressor means, at least a pair of snap action means operable generally relatively and conjointly through discrete snap action movements for effecting the operation of said switching means between the switching modes thereof, and means subjected to the refrigerant fluid pressure established in a preselected part of the system and operable generally in response thereto for transmitting a force to said snap action means to effect their discrete snap action movement, said force transmitting means being operable in response to a preselected low value and a preselected high value of the refrigerant fluid pressure established in the preselected system part to effect the discrete snap action movement of one of said snap action means and each of said snap action means thereby to operate said switching means to one of its switching modes effecting the deenergization of said clutch device and the uncoupling of the driving relation thereof with said refrigerant compressor means, respectively, and said force transmitting means also being responsive to a preselected range of the refrigerant fluid pressure established in the preselected system part and defined between the preselected low and high values thereof to effect the discrete snap action movement of at least one of said one snap action means and another of said snap action means thereby to operate said switching means to the other of its switching modes effecting the energization of said clutch device and the coupling in the driving relation thereof with said refrigerant compressor means.

5. A method of operating an automotive type air conditioning system having a refrigerant compressor means operable generally for establishing a refrigerant fluid pressure in the system, and a control device operable generally for controlling the operation of the refrigerant compressor means including switching means operable generally for switching between a pair of switching modes, and at least a pair of snap action means operable generally relatively and conjointly through discrete snap action movements for effecting the operation of the switching means, the method comprising the steps of:

monitoring the refrigerant fluid pressure in a preselected part of the system and subjecting the control device to the monitored refrigerant fluid pressure;

effecting the operation of the switching means to one of the switching modes thereof when the monitored refrigerant fluid pressure subjected to the control device is within a preselected range thereof so as to effect the operation of the refrigerant compressor means in the system; and effecting the discrete snap action movement of one of the snap action means relative to another of the snap action means to operate the switching means from the one switching mode to the other of the switching modes thereof when a preselected low value of the monitored refrigerant fluid pressure defining the preselected range thereof is subjected to the control device and moving the one and another snap action means generally conjointly through the discrete snap action movements thereof to operate the switching means from the one switching mode to the other switching mode thereof when a preselected high value of the monitored refrigerant fluid pressure defining the preselected range thereof is subjected to the control device.

6. The method as set forth in claim 5 wherein the control device further includes a means operable generally in response to the monitored refrigerant fluid pressure subjected to the control device for actuating the one and another snap action means to effect the discrete snap action movements thereof and wherein the effecting and moving step includes moving the actuating means in response to the monitored refrigerant fluid pressure subjected to the control device and transmitting from the actuating means into the one and another snap action means a force corresponding to the monitored refrigerant fluid pressure subjected to the control device thereby to effect the relative and conjoint discrete snap action movements of the switching means between the one and other switching modes thereof.

7. A method of operating an automotive type air conditioning system having a refrigerant compressor means operable generally for establishing a refrigerant fluid pressure in the system, a clutch device energized for effecting the operation of the refrigerant compressor means in the system and deenergized for interrupting the operation of the refrigerant compressor means in the system, and a control device including at least one switching means operable generally for switching between a pair of switching modes to control the energization and deenergization of the clutch device, and at least a pair of snap action means operable generally relatively and conjointly through discrete snap action movements for effecting the operation of at least the at least one switching means, the method comprising the steps of:

mounting the refrigerant fluid pressure in a preselected part of the system and subjecting the control device to the monitored refrigerant fluid pressure;

effecting the operation of the at least one switching means to one of the switching modes thereof when the monitored refrigerant fluid pressure subjected to the control device is within a preselected range thereby to energize the clutch device effecting the operation of the refrigerant compressor means in the system; and effecting the discrete snap action movement of one of the snap action means relative to another of the snap action means to operate the at least one switching means from the one switching mode to the other of the switching mode thereof when a preseleoted low value of the monitored refrigerant fluid pressure in the preselected range thereof in subjected to the control device thereby to deenergize the clutch device interrupting the operation of the refrigerant compressor means in the system and moving the one and another snap action means at least generally conjointly causing the discrete snap action movements thereof to also operate the at least one switching means from the one switching mode to the other switching mode thereof when a preselected high value of the monitored refrigerant fluid pressure in the preselected range thereof is subjected to the control device thereby to also deenergize the clutch device interrupting the operation of therefrigerant compressor means in the system.

8. The method as set forth in claim 7 wherein the control device further includes a means having an effective area acted upon by the monitored refrigerant fluid pressure subjected to the control device and operable generally in response thereto for actuating the snap action means to effect the discrete snap action movements thereof and wherein the effecting and moving step includes moving the actuating in response to the monitored refrigerant fluid pressure subjected to the control device acting on the effective area of the actuating means and transmitting from the actuating onto the snap action means a force corresponding in magnitude to the monitored refrigerant fluid pressure acting on the effective area of the actuating means thereby to effect the relative and conjoint discrete snap action movement of the at least one switching means between the switching modes thereof.

* * * * *